US006676045B2

(12) United States Patent
Reiter

(10) Patent No.: US 6,676,045 B2
(45) Date of Patent: Jan. 13, 2004

(54) FUEL INJECTION VALVE COMPRISING AN ADJUSTING BUSH

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/275,039

(22) PCT Filed: Feb. 27, 2002

(86) PCT No.: PCT/DE02/00695

§ 371 (c)(1),
(2), (4) Date: Apr. 16, 2003

(87) PCT Pub. No.: WO02/068812

PCT Pub. Date: Sep. 6, 2002

(65) Prior Publication Data

US 2003/0155447 A1 Aug. 21, 2003

(30) Foreign Application Priority Data

Feb. 28, 2001 (DE) ..... 101 09 411

(51) Int. Cl.[7] ..... F02M 51/00

(52) U.S. Cl. ..... 239/585.1; 239/585.2; 239/585.3; 239/585.4; 239/585.5

(58) Field of Search ..... 239/585.1, 585.2, 239/585.3, 585.4, 585.5, 900

(56) References Cited

U.S. PATENT DOCUMENTS

| | | | | |
|---|---|---|---|---|
| 5,165,656 A | | 11/1992 | Maier et al. | |
| 5,301,874 A | | 4/1994 | Vogt et al. | |
| 5,360,197 A | | 11/1994 | Reiter et al. | |
| 5,577,663 A | | 11/1996 | Nally et al. | |
| 5,921,475 A | | 7/1999 | DeVriese et al. | |
| 6,264,112 B1 | * | 7/2001 | Landschoot et al. | 239/585.1 |
| 6,334,576 B1 | * | 1/2002 | Cho | 239/585.1 |
| 6,464,153 B1 | * | 10/2002 | Bonnah et al. | 239/585.1 |
| 6,520,432 B2 | * | 2/2003 | Molnar | 239/585.1 |

FOREIGN PATENT DOCUMENTS

| | | |
|---|---|---|
| EP | 0 301 381 | 2/1989 |
| EP | 0 826 107 | 11/1996 |
| JP | 8-93592 | 4/1996 |

* cited by examiner

*Primary Examiner*—Robin O Evans
(74) *Attorney, Agent, or Firm*—Kenyon & Kenyon

(57) ABSTRACT

A fuel injector includes an armature and a core, which interact with a solenoid coil, a valve needle, which is connected to the armature, seat together with a valve-seat member, and an adjustment sleeve for prestressing a restoring spring, the adjustment sleeve being situated in a central opening of the fuel injector and having an axial slot. The adjustment sleeve, on the inflow side, overlaps a step formed in the central opening. On the inflow side of the step, a gap is formed between the adjustment sleeve and a wall of the central opening. The adjustment sleeve has at least one cutout at an inflow-side end.

7 Claims, 3 Drawing Sheets

Stand der Technik

Stand der Technik

FUEL INJECTION VALVE COMPRISING AN ADJUSTING BUSH

FIELD OF THE INVENTION

The present invention relates to a fuel injector.

BACKGROUND INFORMATION

A fuel injector is described in European Published Patent Application No. 0 826 107, where an adjustment sleeve is introduced into a central opening of fuel injector, in order to calibrate the fuel flow. The fuel injector is designed as a so-called bottom-feed fuel injector, the adjustment sleeve being situated in a second, top-feed fuel inlet of the fuel injector, and the initial spring tension of a restoring spring being able to be calibrated for both supply options, in the same procedure.

A disadvantage of the adjustment sleeve described in European Published Patent Application No. 0 826 107 is the risk of damaging the interior of the valve during the installation of the adjustment sleeve, and the risk of subsequent malfunctioning of the fuel injector as a result of leaks or the deposition of abraded or splintered-off shavings. Damage may be caused by the adjustment sleeve itself, but it may also be caused by the tool used for installing the adjustment sleeve.

SUMMARY

The fuel injector of the present invention has an opening in the adjustment sleeve that keeps the force required for pressing the adjustment sleeve into the opening of the fuel injector constant.

The introduction of two cutouts offset 120° from each other may allow the pinching action of the adjustment sleeve to be extended to a larger wall region.

The design the adjustment sleeve may be symmetrical, using one cutout on each end, since this allows the production step of aligning the adjustment sleeve prior to installation to be eliminated.

In addition, the cutouts may be formed in the shape of a rectangle, up to the angle, and may thus be introduced into the adjustment sleeve in a simple manner.

In the region of the cutouts, the adjustment sleeve may have beveled axial edges, which may prevent damage in the valve interior during assembly.

Exemplary embodiments of the present invention are illustrated schematically in the drawings and explained in detail in the following description.

DETAILED DESCRIPTION

Figure 1:
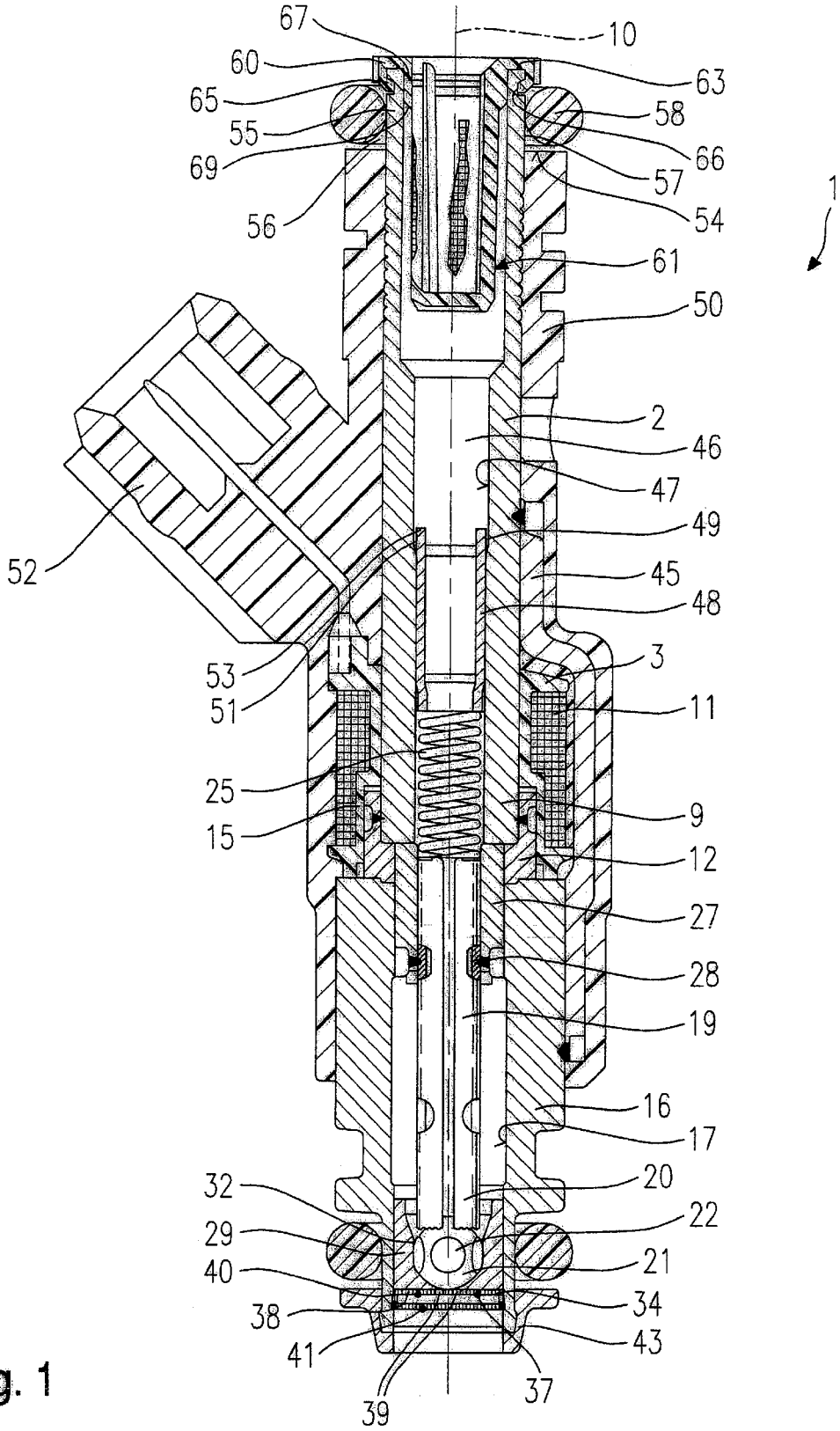
FIG. 1 is a schematic cross-sectional view through a first example embodiment of a fuel injector according to the present invention.

The example embodiment of an electromagnetically operable fuel injector 1 illustrated in FIG. 1 has a tubular core 2, which is surrounded by a solenoid coil 11, is used as a fuel inlet spout, and has a constant outer diameter over its entire length. A coil shell 3 graded in the radial direction accommodates a winding of solenoid coil 11 and, in conjunction with core 2, enables fuel injector 1 to have a compact design in the region of solenoid coil 11.

A tubular, metallic adapter 12 is connected to a lower core end 9 of core 2, e.g. by welding, so as to be concentric to a major axis 10 of fuel injector 1, and to form a seal. Adapter 12 axially surrounds a portion of core end 9. Graded coil shell 3 partially covers core 2, and its step 15 having a greater diameter axially covers at least a portion of adapter 12. A tubular valve-seat support 16, which may be rigidly connected to adapter 12, extends downstream from coil shell 3 and adapter 12. A longitudinal bore 17, which is concentric to major axis 10 of fuel injector 1, runs through valve-seat support 16. Situated in longitudinal bore 17 is a, e.g. tubular valve needle 19, whose downstream end 20 may be connected, for example, by welding, to a spherical valve-closure member 21, on whose periphery, e.g. five flat areas 22 are provided for the fuel to flow past.

Fuel injector 1 is electromagnetically actuated in a conventional manner. The electromagnetic circuit having solenoid coil 11, core 2, and an armature 27 is used for axially moving valve needle 19, and therefore, for opening fuel injector 1 in opposition to the spring force of a restoring spring 25, and for closing fuel injector 1. Armature 27 is connected to the end of valve needle 19 opposite valve-closure member 21, by a first welded seam 28, and is aligned with core 2. In longitudinal opening 17, a cylindrical valve-seat member 29 having a fixed valve seat is mounted in the downstream end of valve-seat support 16 opposite to core 2, for example, by using welding, so as to form a seal.

A guide opening 32 of valve-seat member 29 is used to guide valve-closure member 21 along major axis 10 of fuel injector 1, during the axial movement of valve needle 19 with armature 27. Spherical valve-closure member 21 interacts with the valve seat of valve-seat member 29, which is frustoconically tapered in the direction of flow. The periphery of valve-seat member 29 has a diameter that is slightly less than that of longitudinal bore 17 of valve-seat support 16. The end face of valve-seat member 29 facing away from valve-closure member 21 is rigidly and concentrically connected to a, e.g. cup-shaped, apertured spray disk 34, using, e.g. a circumferential, sealed, second welded seam 37 that is formed, for example, by a laser.

In addition to a base part 38, to which valve-seat member 29 is attached, and in which at least one spray-discharge opening 39 is formed, e.g. by erosion or stamping, cup-shaped, apertured spray disk 34 has a circumferential retention rim 40 running in the downstream direction. Retention rim 40 is conically bent to the outside in the downstream direction, so that it rests against the inner wall of valve-seat support 16 defined by longitudinal bore 17, in which case radial compression occurs. In addition, the direct flow of fuel outside of spray-discharge opening 39, into an intake line of the internal combustion engine, is prevented by a third welded seam 41 between apertured spray disk 34 and valve-seat support 16. A protective cap 43 is situated at the circumference of valve-seat support 16, at its downstream end facing away from core 2, and is joined to valve-seat support 16, e.g. using a snap-in connection.

The insertion depth of the valve-seat member 29 having cup-shaped, apertured spray disk 34 presets the lift of valve needle 19. In the case of solenoid coil 11 not being energized, the one end position of valve needle 19 is established by the contact of valve-closure member 21 with the valve seat of valve-seat surface 29, while, in the case of solenoid coil 11 being energized, the other end position of valve needle 19 results from the contact of armature 27 with core end 9.

Solenoid coil 11 is surrounded by at least one conductive element 45, which may be formed in the shape of a clip, is used as a ferromagnetic element, and at least partially surrounds solenoid coil 11 in the circumferential direction, and whose one end rests against core 2, and whose other end rests against valve-seat support 16 and is connectable to it, e.g. by welding, soldering, or adhesive bonding.

An adjustment sleeve 48, which is inserted into a central opening 46 of core 2 extending concentrically to major axis 10 of fuel injector 1, and may be formed from, for example, rolled spring steel, is used to adjust the initial spring tension of restoring spring 25, which rests against adjustment sleeve 48, and whose opposite side is, in turn, braced against valve needle 19.

According to the present invention, adjustment sleeve 48 is designed to overlap a step 49 of wall 47 of central opening 46 of core 2 in the upstream direction. This produces a gap 51 between wall 47 and an inflow-side end 53 of adjustment sleeve 48, the gap at least setting adjustment sleeve 48 far enough apart from wall 47 to prevent a mounting tool applied to inflow-side end 53 of adjustment sleeve 48 from coming into contact with wall 47. A more detailed description of the arrangement according to the present invention as further, example embodiments, are illustrated in FIGS. 3 to 5.

Fuel injector 1 is largely surrounded by a plastic extrusion coat 50, which extends in the axial direction from core 2, over solenoid coil 11 and at least one conductive element 45, to valve-seat support 16, the at least one conductive element 45 being completely covered in the axial and circumferential directions. This plastic extrusion coat 50 may include a plug connector 52 that is also extruded on.

The boundary of plastic extrusion coat 50 situated oppositely to valve-closure member 21 forms a lateral face 54 of an annular groove 56 provided at the circumference of inflow-side end 55 of core 2. A groove base 57 of the annular groove 56 having an upper sealing ring 58 is formed by the circumference of core 2. The boundary of annular groove 56 opposite to lateral surface 54 is produced by a plastic retaining collar 60, which is formed in one piece with a fuel filter 61. Fuel filter 61 extends into central opening 46 of core 2, at its inflow-side end 55, and filters out fuel components whose size may cause blockages or damage in the fuel injector.

After the installation of fuel filter 61, collar 60, which points radially to the outside and forms a lateral surface of annular groove 56 of sealing ring 58, rests, e.g. directly on an end face 63 of inflow-side end 55 of core 2 or forms a small, axial gap with respect to end face 63. In order to reach this state of mounting, with the aid of a tool a very small force may be generated that acts in the axial direction, along major axis 10 of fuel injector 1, on fuel filter 61, whereby a lip 65 of retaining collar 60 may snap into a groove 66 on the circumference of core 2. Because lip 65 of retaining collar 60 snaps in at the outer circumference of core 2, it is not necessary to press fuel filter 61 into central opening 46 of core 2, which may create shavings. Instead, a clearance fit is produced between a base 67 of fuel filter 61 extending axially in the direction of major axis 10 of fuel injector 1, and wall 47 of central opening 46 of core 2, up to a shoulder 69 on base 67, while the part of fuel filter 61 situated downstream from shoulder 69 extends through central opening 46 at a marked distance from wall 47 of core 2, without touching it.

Figure 2A:
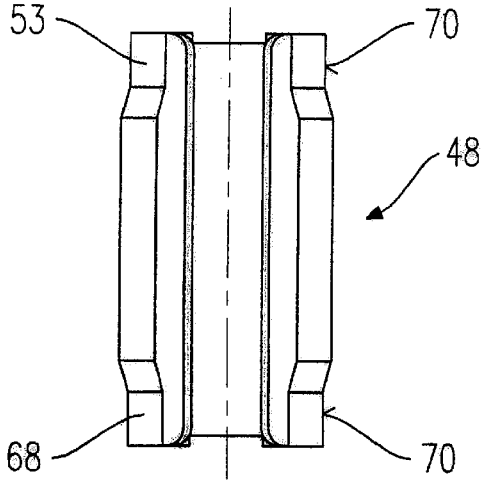
FIG. 2A is a schematic elevation view of an adjustment sleeve.
Figure 2B:
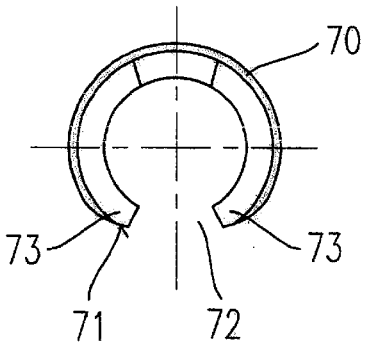
FIG. 2B is a schematic top view of an adjustment sleeve.

FIGS. 2A and 2B show a schematic elevation view and a top view of an example embodiment of an adjustment sleeve 48. Identical parts are provided with the same reference numerals in all of the figures.

Adjustment sleeve 48 is normally pressed into central opening 46 of fuel injector 1 in such a manner that the entire length, e.g. 8 mm, of the adjustment sleeve contacts wall 47 of central opening 46 of core 2. A mounting tool needed for pressing in adjustment sleeve 48 may produce shavings at wall 47 in response to the smallest deviation from major axis 10 of fuel injector 1, and this may cause leaks or malfunctions in fuel injector 1, due to the deposition of shavings. The top view of inflow-side end 53 of adjustment sleeve 48 represented in FIG. 2B shows radial bevels 70 in the region of an inflow-side end 53 and a discharge end 68, as well as axial bevels 71 in the region of a slot 72 of adjustment sleeve 48, in order to prevent shavings from adjustment sleeve 48 when it is installed. However, these known measures may not prevent damage caused by the mounting tools.

The described example embodiments according to the present invention counteract this and may lead to simpler and more reliable installation of adjustment sleeve 48, which may be carried out without damaging wall 47 or adjustment sleeve 48.

Figure 3A:
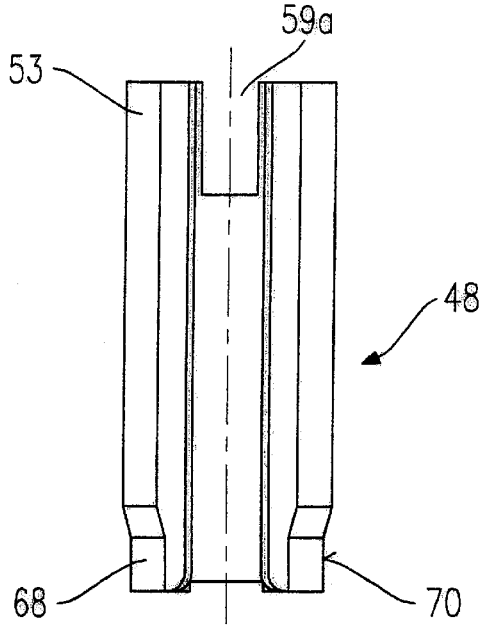
FIG. 3A is a schematic elevation view of the adjustment sleeve for a first example embodiment of the fuel injector according to the present invention.
Figure 3B:
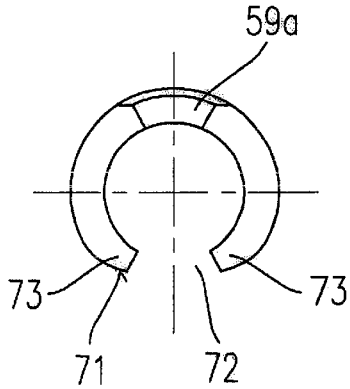
FIG. 3B is a schematic top view of the adjustment sleeve for a first example embodiment of the fuel injector according to the present invention.

FIGS. 3A and 3B show a schematic elevation view and a top view of a first example embodiment of an adjustment sleeve 48 of fuel injector 1 according to the present invention.

The length of adjustment sleeve 48 may be, for example, increased by 2 mm in comparison to conventional arrangements. This allows its inflow-side end 53 to overlap a step 49 of wall 47 of central opening 46 of core 2, the wall having several steps in the exemplary embodiment. Inflow-side end 53 of adjustment sleeve 48 consequently may not rest against inner wall 47 of central opening 46, but instead forms a gap 51. If a tool is applied to inflow-side end 53 of adjustment sleeve 48, in order to install adjustment sleeve 48, gap 51 may prevent it from contacting wall 47 of central opening 46. In this manner, shavings may be prevented from being formed when the tool is tilted. In addition, the greater overall length of adjustment sleeve 48 simplifies installation, since the mounting tool does not have to be inserted so far into central opening 46 of fuel injector 1.

Downstream from step 49, the greater overall length of adjustment sleeve 48 produces a larger contact surface between adjustment sleeve 48 and wall 47. Accordingly, the first example embodiment of adjustment sleeve 48 of the fuel injector 1 according to the present invention has a cutout 59*a* in inflow-side end 53 to compensate for the greater overall length, so that the resulting pinching action of adjustment sleeve 48 is equal to that of the conventional arrangement, and a larger force is not needed to install adjustment sleeve 48. In this context, cutout 59*a* may be rectangular, but may also have other shapes, such as a rounded shape. This may reduce the area in contact with wall 47 to such an extent that the pressing force remains the same as that of a conventional adjustment sleeve.

It may be seen in the top view of inflow-side end 53 of the example embodiment of an adjustment sleeve 48 shown in FIG. 3B, that radial bevels 70 may be dispensed with on inflow-side end 53, which simplifies the manufacture of adjustment sleeve 48.

Figure 4A:
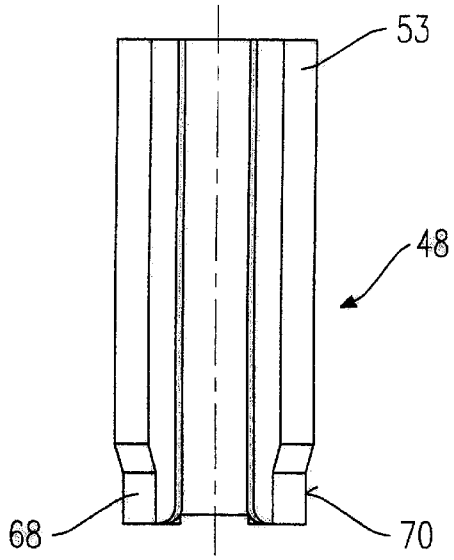
FIG. 4A is a schematic elevation view of the adjustment sleeve for a second example embodiment of the fuel injector according to the present invention.
Figure 4B:
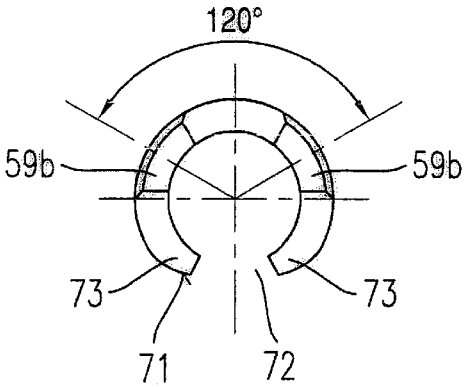
FIG. 4B is a schematic top view of the adjustment sleeve for a second example embodiment of the fuel injector according to the present invention.

FIGS. 4A and 4B show a schematic elevation view and a top view of a second example embodiment of an adjustment sleeve 48 of a fuel injector 1 according to the present invention.

Adjustment sleeve 48 has, instead of one cutout 59*a*, two cutouts 59*b* that may be offset from each other by an angle of 120°. FIG. 4A shows cutouts 59*b* covered by projecting wings 73 of adjustment sleeve 48, but they are visible in FIG. 4B.

In this context, the length of cutouts 59*b* may remain the same as, for example, that of the first exemplary embodiment illustrated in FIGS. 3A and 3B. This configuration takes into account that, due to adjustment sleeve 48 being designed as an elastic spring sleeve, it is subjected to stresses that cause adjustment sleeve 48 not to rest against wall 47 of central opening 46 of core 2 with its entire surface, but rather with axial, parallel contact lines, which extend on adjustment sleeve 48, essentially along wings 73 of adjustment sleeve 48 and oppositely to slot 72. Two cutouts 59*b* allow more uniform contact and, thus, better force distribution and better pinching action to be attained.

Figure 5A:
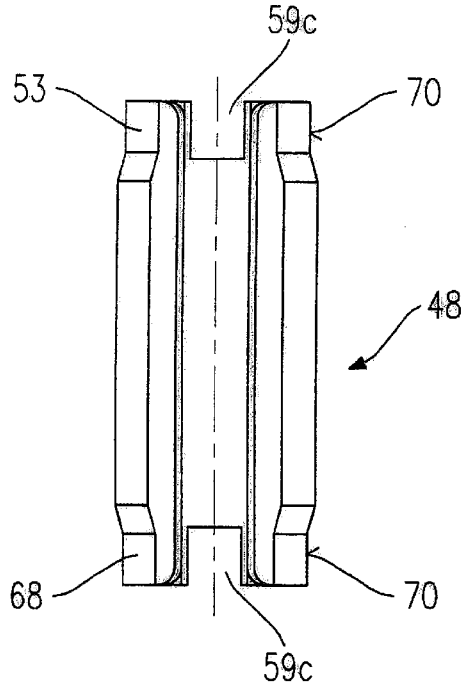
FIG. 5A is a schematic elevation view of the adjustment sleeve for a third example embodiment of the fuel injector according to the present invention.
Figure 5B:
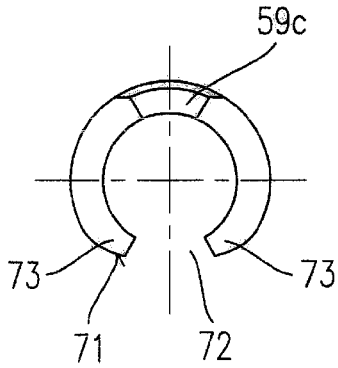
FIG. 5B is a schematic top view of the adjustment sleeve for a third example embodiment of the fuel injector according to the present invention.

FIGS. 5A and 5B show a schematic elevation view and a top view of a third example embodiment of an adjustment sleeve 48 of a fuel injector 1 according to the present invention.

An exemplary embodiment of an adjustment sleeve 48, which may be manufactured and installed in a simple manner, is illustrated in FIGS. 5A and 5B. According to the present invention, adjustment sleeve 48 is constructed to have a greater overall length, but has a cutout 59*c* not only on inflow-side end 53, but also on discharge end 68, the cutouts being, e.g. only half as long as the ones in the above-mentioned example embodiments. This also allows the pressing force for adjustment sleeve 48 to remain the same. An advantage of the example embodiment may be in the symmetry of adjustment sleeve 48, which may be assembled in a nondirectional manner, so that the need for the method step of aligning the part prior to installation may be eliminated.

The present invention is not limited to the example embodiments represented and may also be applied to other designs of fuel injectors 1, such as fuel injectors for direct injection of fuel into the combustion chamber of an internal combustion engine, as well as fuel injectors in a common-rail system.

What is claimed is:

1. A fuel injector, comprising:

an armature and a core configured to interact with a solenoid coil;

a valve-seat member;

a valve needle connected to the armature and including a valve-closure member configured to form a sealing seat with the valve-seat member;

a restoring spring; and an adjustment sleeve arranged in a central opening of the fuel injector and configured to prestress the restoring spring, the adjustment sleeve including an axial slot, the adjustment sleeve overlapping, at an inflow side, a step formed in the central opening, a gap arranged at the inflow side of the step between the adjustment sleeve and a wall of the central opening, the adjustment sleeve including at least one cutout at an inflow-side end.

2. The fuel injector according to claim 1, wherein the at least one cutout is diametrically opposed to the axial slot of the adjustment sleeve.

3. The fuel injector according to claim 1, wherein the adjustment sleeve includes two cutouts disposed at the inflow-side end.

4. The fuel injector according to claim 3, wherein the cutouts are angularly spaced approximately 120° apart from each other.

5. The fuel injector according to claim 1, wherein the a first cutout is disposed at the inflow-side end of the adjustment sleeve and a second cutout is disposed at a discharge end of the adjustment sleeve.

6. The fuel injector according to claim 1, wherein the cutouts are substantially rectangular.

7. The fuel injector according to claim 1, wherein the cutouts include axial bevels.

* * * * *

UNITED STATES PATENT AND TRADEMARK OFFICE

CERTIFICATE OF CORRECTION

PATENT NO. : 6,676,045 B2
DATED : January 13, 2004
INVENTOR(S) : Ferdinand Reiter It is certified that error appears in the above-identified patent and that said Letters Patent is hereby corrected as shown below:

Title page,
Item [57], ABSTRACT, change "armature, seat together" to -- armature, together --

Column 1,
Line 37, change "The design the adjustment" to -- The design of the adjustment --

Column 3,
Line 43, change "are illustrated" to -- is illustrated --

Column 6,
Line 39, change "wherein the a" to -- wherein the --

Signed and Sealed this

Twenty-seventh Day of July, 2004

JON W. DUDAS
*Acting Director of the United States Patent and Trademark Office*